US005928091A

United States Patent [19]

Corriveau

[11] Patent Number: 5,928,091

[45] Date of Patent: Jul. 27, 1999

[54] GOLF BALL HANDLER

[76] Inventor: David R. Corriveau, 205 Munn Rd., Monson, Mass. 01057

[21] Appl. No.: 09/037,738

[22] Filed: Mar. 10, 1998

[51] Int. Cl.[6] ..... A63B 57/00

[52] U.S. Cl. ..... 473/386

[58] Field of Search ..... 473/386, 132, 473/284, 286; 294/19.1, 19.2

[56] References Cited

U.S. PATENT DOCUMENTS

| | | | |
|---|---|---|---|
| 499,813 | 3/1893 | Black | 473/386 |
| 2,609,198 | 9/1952 | Armstrong | 473/386 |
| 3,889,946 | 6/1975 | Setecka | 473/386 |
| 4,526,369 | 7/1985 | Phelps | 473/386 |
| 4,819,938 | 4/1989 | Hill | 473/386 |
| 4,949,961 | 8/1990 | Milano | 473/386 |
| 4,951,947 | 8/1990 | Kopfle | 473/386 |
| 4,969,646 | 11/1990 | Tobias | 473/386 |
| 5,080,357 | 1/1992 | Wolf | 473/386 |
| 5,205,598 | 4/1993 | Miller | 473/386 |
| 5,310,177 | 5/1994 | Conrad et al. | 473/386 |
| 5,330,178 | 7/1994 | Geishert, Sr. | 473/386 |
| 5,439,213 | 8/1995 | Pimentel | 473/386 |
| 5,540,432 | 7/1996 | Keller | 473/386 |

FOREIGN PATENT DOCUMENTS

| | | |
|---|---|---|
| 671704 | 9/1989 | Switzerland . |
| 2035185 | 6/1980 | United Kingdom . |

*Primary Examiner*—Steven Wong
*Attorney, Agent, or Firm*—Richard C. Litman

[57] ABSTRACT

A golf tee and ball setting device, which requires no stooping or bending by a user when setting a tee and ball, comprises an elongated handle having a lower end with an arcuate surface for receiving a golf ball. A lever device is pivotally attached to the handle adjacent to the lower end and employs a leaf spring biased to hold a golf ball and tee in axial alignment with the handle. Downward pressure is applied to the handle to insert and set the tee firmly into the ground. The user's foot is then applied to pivot the lever device and release the set tee and golf ball.

6 Claims, 3 Drawing Sheets

GOLF BALL HANDLER

BACKGROUND OF THE INVENTION

1. Field of the Invention

The present invention relates to golf accessories and, more specifically, to a device for setting a golf ball and tee.

2. Description of the Related Art

The game of golf requires that a participant set a tee in the ground and place a golf ball on the tee at the beginning of each hole of play. This physical act requires bending and stooping which may be quite painful and/or difficult for participants with bad knees, backs, or hips.

The prior art discloses many devices for facilitating tee and ball setting without bending or stooping however, the prior art devices require relatively complicated systems for performing the task. For example, U.S. Pat. Nos. 2,609,198 (Armstrong), 4,526,369 (Phelps), 4,951,947 (Kopfle), 4,969,646 (Tobias), 5,080,357 (Wolf), 5,330,178 (Geishert, Sr.), and 5,439,213 (Pimentel) disclose tee and ball setting devices which require plunger rods utilizing spring return mechanisms. U.S. Pat. Nos. 4,949,961 (Milano), 5,205,598 (Miller), and 5,540,432 (Keller) show tee and ball setting devices which require lever and spring actuating mechanisms. U.S. Pat. No. 5,310,177 (Conrad et al.) utilizes a hooked handle and forked slide device to set a tee and ball. Patent Number 2,035,185 (Great Britain) discloses a device for picking up golf balls. Patent Number 671,704 (Switzerland) requires separate actions to set a tee and ball.

None of the above inventions and patents, taken either singularly or in combination, is seen to describe an uncomplicated device requiring only two parts as shown and claimed in the instant invention. Thus a golf ball handler solving the aforementioned problems is desired.

SUMMARY OF THE INVENTION

The golf tee and ball setting device of the present invention comprises an elongated rigid handle with a pivoted lever fitted at one end of the handle. The pivoted lever includes a spring arm designed to hold a golf ball and a tee in axial alignment with the handle. While the ball is so engaged, the handle permits a users to press and set the tee into the ground. The pivoted lever further includes a pedal which when engaged by the user's foot causes the spring arm to release the tee, thereby leaving the tee and golf ball set and ready for play.

Accordingly, it is a principal object of the invention to provide a golf tee and ball setting device.

It is another object of the invention to provide a golf tee and ball setting device that enables the user to set the tee and ball from an upright position.

It is a further object of the invention to provide a golf tee and ball setting device made of a minimum number of parts.

Still another object of the invention is to provide a golf tee and ball setting device which is simplistic in use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
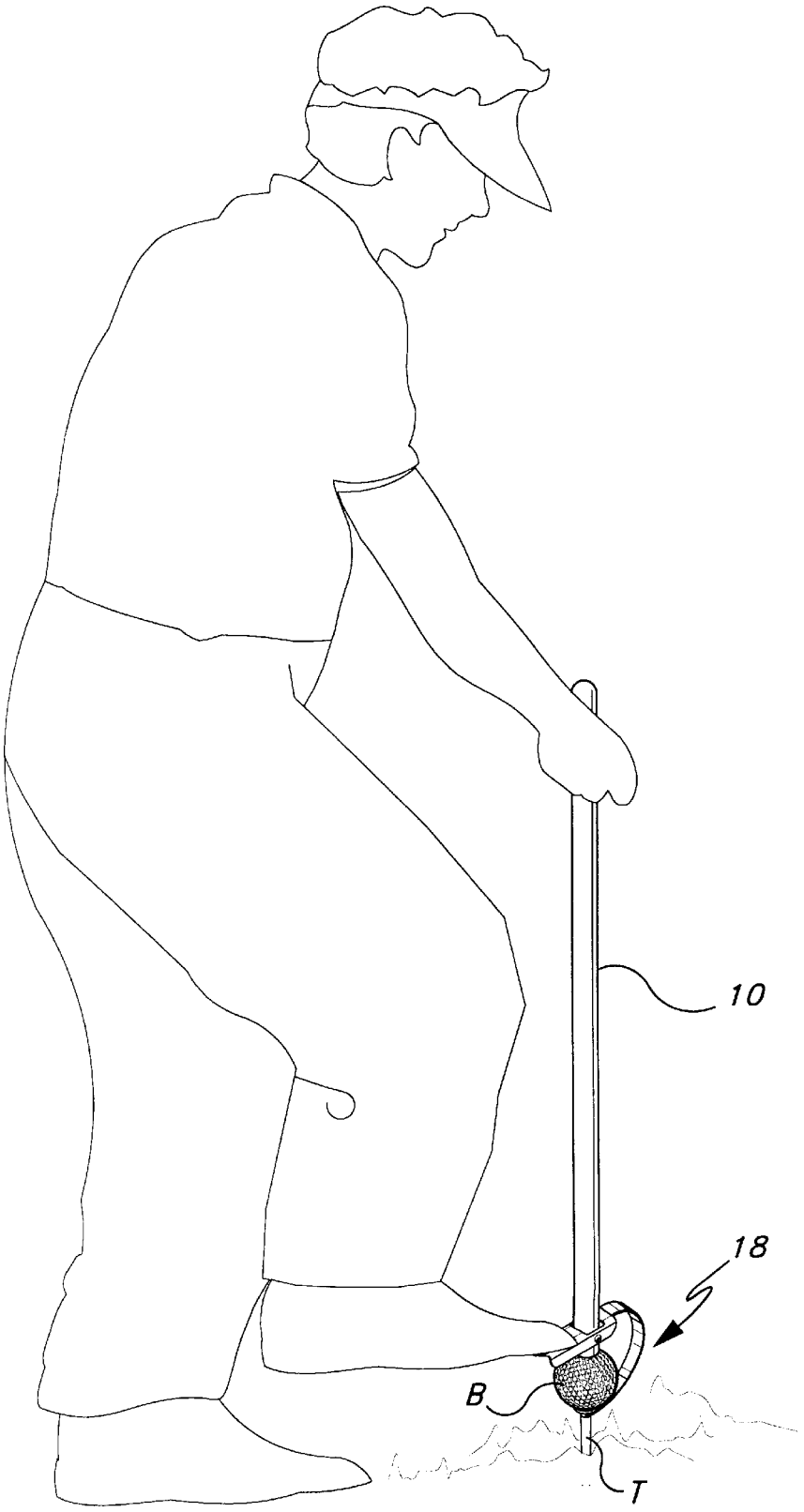
FIG. 1 is an environmental view of a golf tee and ball setting device of the present invention.
Figure 2:
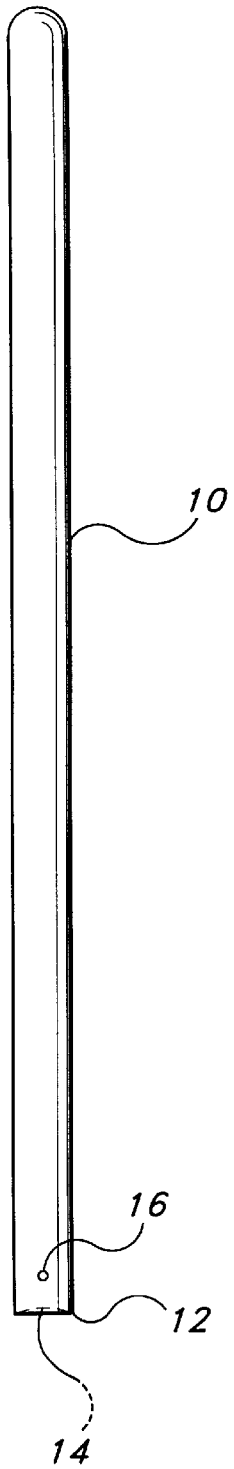
FIG. 2 is a plan view of a handle of a golf tee and ball setting device of the present invention.

The golf tee and ball setting device of the present invention, as illustrated in FIGS. 1, 2, 3 and 4, comprises an elongated handle 10 approximately 1 inch in diameter and approximately 30 inches long. Handle 10 may be fabricated of any suitable rigid material such as wood, metal, or plastic. At one end 12 thereof, handle 10 is provided with an arcuate seat 14 for receiving a golf ball B. A bore 16 is formed through handle 10 at approximately 0.90 inches from end 12. A foot operated lever device 18 is affixed to handle 10 with a pivot pin 11 or the like inserted through lever device 18 and bore 16 formed in handle 10.

Figure 4:
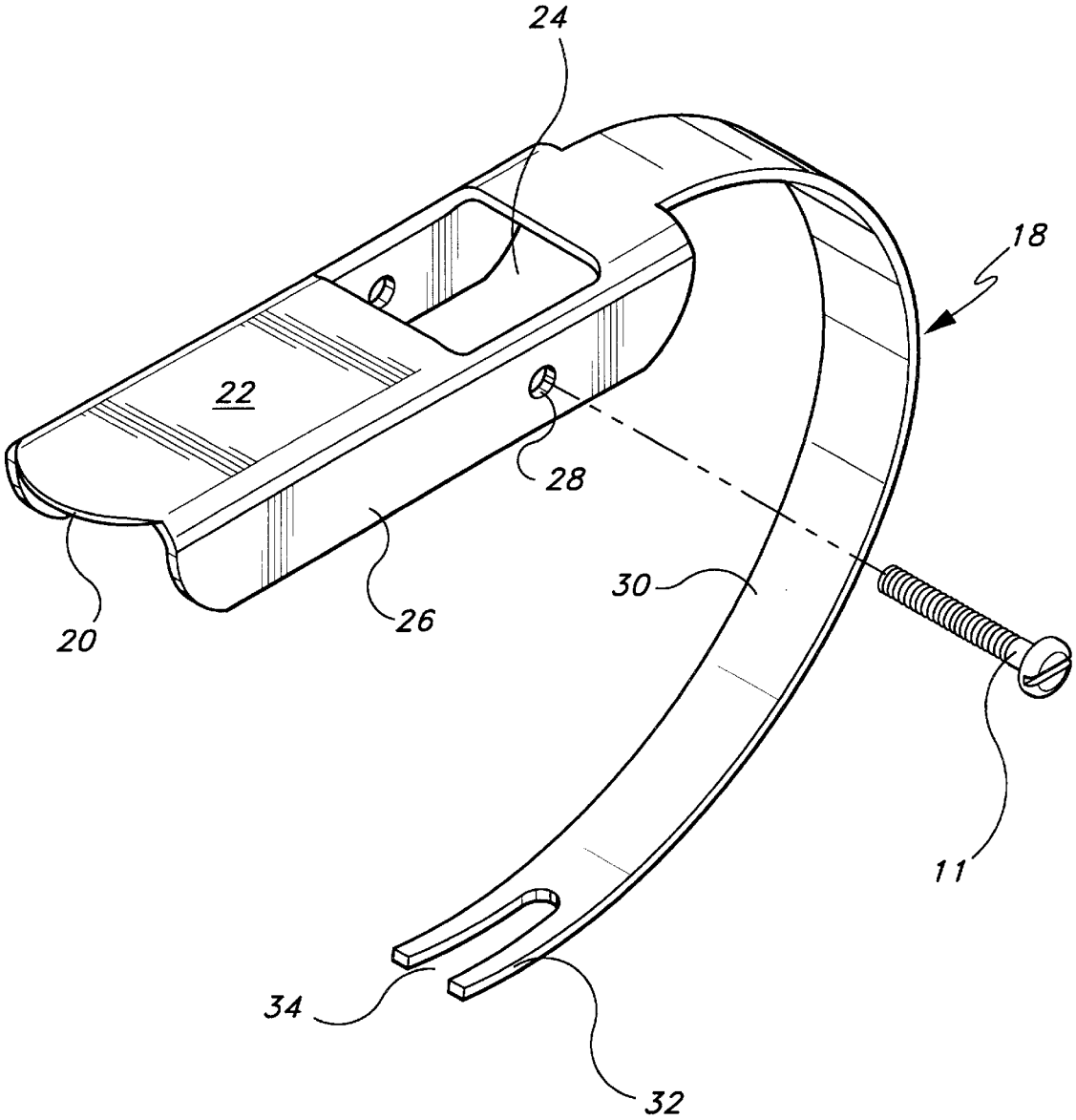
FIG. 4 is a perspective view of a lever device of a golf tee and ball setting device of the present invention.

As best seen in FIG. 4, lever device 18 is a c-shaped spring arm element with one end 20 formed as a planar surface 22 to define a foot pedal. Two flanges 26 depend perpendicularly from surface 22 and surface 22 has an open portion 24 formed therein for receiving handle 10. Flanges 26 each have bores 28 formed therein in a manner such that a horizontal axis traversing the bores 28 would perpendicularly intersect a central vertical axis of open portion 24; moreover, the open portion 24 is dimensioned and configured to be large enough to allow pivotal movement of lever device 18 relative to handle 10 with each bore 28 so positioned.

A ball and tee holder arm 30 extends from planar surface 22 and terminates in a second end 32. Second end 32 is formed as a bifurcated notch 34 for engaging a golf tee T. Lever device 18 may be fabricated of metal, plastic, or any suitable resilient, durable material having a shape-retaining memory. The chosen material permits ends 20 and 32 to be spaced apart a suitable distance such that in use, second end 32 biases a ball B and tee T toward arcuate seat 14, thereby firmly gripping it against the handle 10.

Assembly of the present invention would merely require insertion of handle 10 through open portion 24 of lever device 18 so that bores 28 in flanges 26 and bore 16 in handle 10 are in alignment. Pivot pin 11 would then be inserted through bores 28 and 16 and secured therein.

Figure 3:
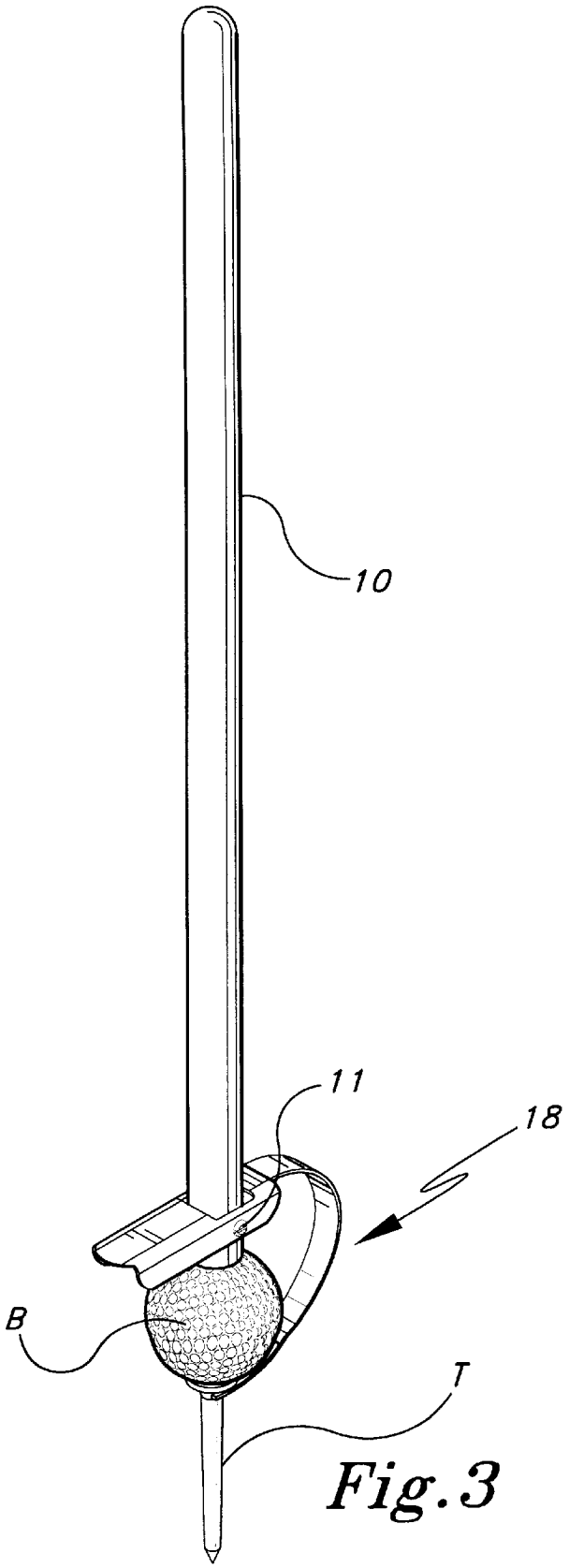
FIG. 3 is a perspective view of a golf tee and ball setting device of the present invention.

To use the present invention, a user would place a tee T in tee notch 34. A golf ball B would then be inserted in arcuate seat 14 atop the tee T and aligned with handle 10 as shown in FIG. 3. Downward pressure on handle 10 would function to firmly press and set the tee T into the ground. Utilizing a foot to apply downward pressure on planar surface 22 would cause lever device 18 to pivot on pivot pin 11 releasing the tee notch 34 from the tee T, thus negating any need for stooping or bending.

It is to be understood that the present invention is not limited to the embodiment described above, but encompasses any and all embodiments within the scope of the following claims.

I claim:

1. A golf tee and ball setting device comprising:

an elongated handle having an upper end and a lower end defining an axis therebetween, said lower end terminating along said axis in a surface for receiving a ball;

a lever device depending from said lower end of said handle, said lever device defining a first end portion defining a foot pedal depending outwardly from said lower end of said handle, a second end portion defining means for holding a golf tee, and a spring arm integrally connecting said first end portion and said second end portion of said lever device, said arm made of a resilient material and configured to space said second end portion from said surface of said handle by a predetermined distance, thereby defining a first state wherein said spring arm biases said second end portion against the ball when placed between said surface and a tee held by said second end portion in alignment with said axis; and pivot means for pivotally attaching said lower end of said handle to said first end portion and for alternating said lever device between said first state and a second state wherein, when said foot pedal is depressed, said spring arm is caused to be angularly displaced thereby angularly displacing said second end portion out of alignment with said axis;

whereby, when a ball is placed upon said surface and a tee is received by said second end portion, said spring arm urges said tee against said ball and said surface, thereby firmly grasping said ball against said handle, and whereby further, when said pedal is depressed, said second end portion releases said tee to permit removal of said setting device from both said ball and said tee.

2. A golf tee and ball setting device as defined in claim 1 wherein said first end portion defines an opening for passing said lower end of said handle.

3. A golf tee and ball setting device as defined in claim 2 wherein said first end portion includes a planar surface and flange members perpendicularly depending therefrom, wherein said flange members have axially aligned bores formed therein, wherein said handle includes a bore formed through said lower end and said pivot means is defined by a pivot pin extending through said handle bore and said lever device bores.

4. A golf tee and ball setting device as defined in claim 1 wherein said second end of said lever device is bifurcated defining a notch.

5. A golf tee and ball setting device as defined in claim 1, wherein said surface is arcuate.

6. A golf tee and ball setting device comprising:

an elongated handle having an upper end and a lower end, said lower end terminating in an arcuate surface for receiving a ball;

a bore formed through said handle adjacent said lower end;

a lever device positioned adjacent said lower end of said handle, said lever device having two end portions;

a first end portion of said lever device having a planar surface and having an opening defined therein to receive said lower end of said handle, flange members perpendicularly depending from said planar surface, said flange members having axially aligned bores formed therein;

a ball and tee holder arm extending from said planar surface;

and a second end portion of said lever device, said second end portion including a bifurcation defining a notch; and a pivot pin extending through said bore in said handle and said bores in said flanges for pivotally attaching said lever device to said handle adjacent said lower end thereof.

* * * * *